United States Patent [19]

Liljekvist et al.

[11] 4,004,644

[45] Jan. 25, 1977

[54] ROLLER CUTTER

[75] Inventors: Bernt Soren Liljekvist; Anders Persson, both of Sandviken, Sweden

[73] Assignee: Sandvik Aktiebolag, Sandviken, Sweden

[22] Filed: Jan. 27, 1976

[21] Appl. No.: 652,864

[30] Foreign Application Priority Data

Jan. 27, 1975 Sweden ..... 7500816

[52] U.S. Cl. ..... 175/364; 175/53; 308/18; 308/31

[51] Int. Cl.[2] ..... E21B 9/08

[58] Field of Search ..... 175/342, 363, 364, 367, 175/368, 383, 53; 308/8.2, 19, 31; 37/142 R, 142 A

[56] References Cited

UNITED STATES PATENTS

| | | | |
|---|---|---|---|
| 3,054,466 | 9/1962 | Wagnon et al. | 175/342 |
| 3,612,196 | 10/1971 | Dixon | 175/364 |
| 3,747,999 | 7/1973 | Justman | 175/364 |
| 3,749,188 | 7/1973 | Schumacher, Jr. | 175/364 |
| 3,835,944 | 9/1974 | Bingham | 175/364 |

*Primary Examiner*—Ernest R. Purser
*Assistant Examiner*—Richard E. Favreau
*Attorney, Agent, or Firm*—Pierce, Scheffler & Parker

[57] ABSTRACT

In the saddle structure of the improved drill bit cutter assembly of the invention both spaced-apart legs are provided with bores each extending through the leg to receive a clamping bolt. These bores extend in directions including between them an angle of up to 90°. The shaft-receiving recess, between the legs, has a polygonal shape complementing that of the end portion of the shaft.

5 Claims, 3 Drawing Figures

ROLLER CUTTER

This invention relates to the drilling art, and is concerned with improvements in roller cutters.

In roller cutters, the rollers and the bearing shafts on which they are rotatably mounted are subject to appreciable compressive stresses both axially and radially. There is a specific problem encountered with the roller cutters used for tunneling and raise boring operations, due to the stationary mounting of the bearing shaft on which the roller is supported. As a consequence thereof, the bearing shaft is exposed to a very concentrated wear on a minor portion of the mantle surface of such bearing shaft.

The present invention aims at a solution to above related problems. To this end, both spaced-apart legs of a saddle structure of a drill bit cutter assembly are provided with bores each of which extends entirely through the legs to receive a clamping bolt, said bores extending in directions including therebetween an angle of 0°–90°, and the shaft-receiving recess between said legs being of a polygonal shape complemental to that of the end portion of said shaft such that said shaft is adjustable in two positions having its bolt-receiving transverse bore aligned with those of said legs in both said positions.

Figure 1:
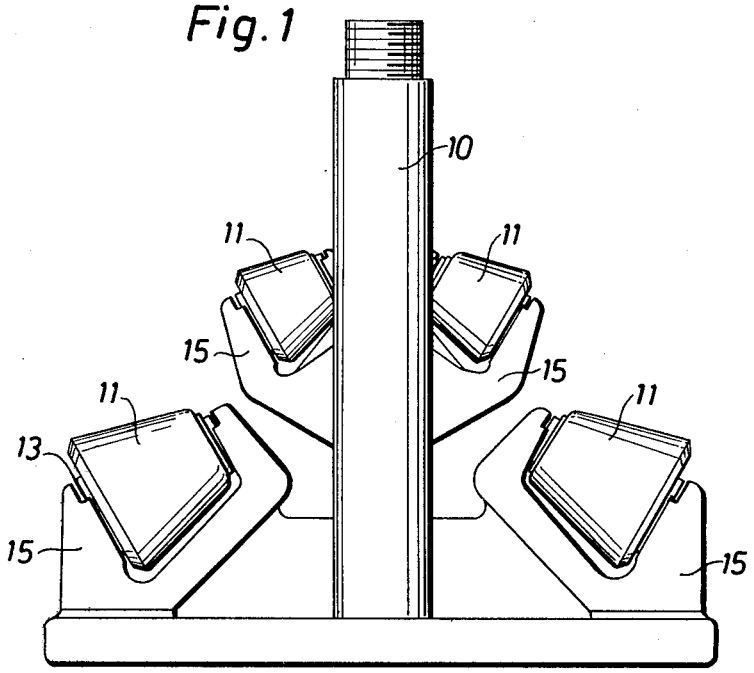
Figure 2:
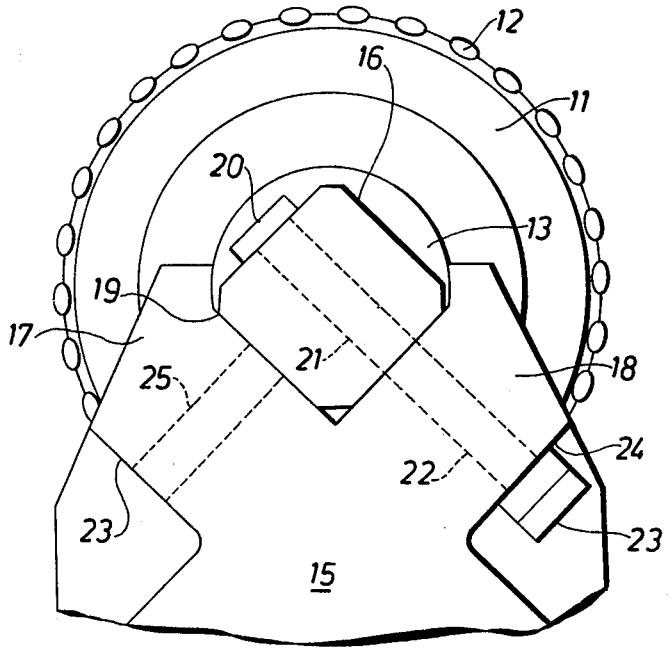
Figure 3:
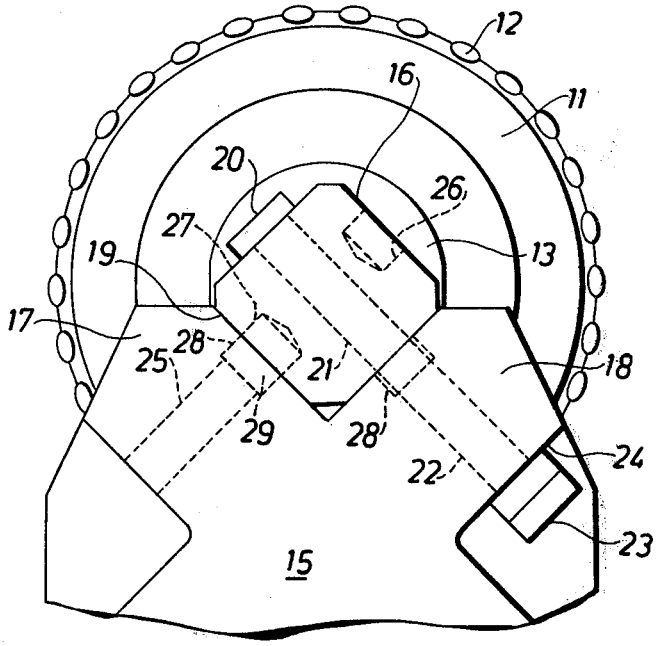

The invention will now be explained in greater detail and with reference to the appended drawings, which illustrate a preferred embodiment of the present invention, in which drawings FIG. 1 shows a conventional bit cutter assembly for raise boring;

FIG. 2 shows an end view of the bearing shaft received between spaced-apart legs of a saddle structure; and FIG. 3 shows an end view of an alternative embodiment of the bearing shaft shown in FIG. 2.

Referring now to FIG. 1, a raise-boring equipment is shown which comprises a central shaft 10 and cutters 11 arranged concentrically therearound to function as first and second cutting stages. The cutters 11 are to be rotated by means of a system well known in the art.

Each cutter 11 comprises a conically shaped roller the mantle surface of which is equipped with cutting bits 12 of hard metal or other wear-resistant material. Each said conical roller is rotatably mounted on a cylindrical bearing shaft 13 that is stationarily held in position by saddles 15. In FIG. 2 there is shown only one circular row of bits 12 on said conical mantle surface of the cutter 11.

Referring now to FIG. 2, the end portion 16 of shaft 13 has a regular polygonal shape; it is square-shaped. The end portion 16 extends into a recess 19 between legs 17 and 18 of saddle 15, said recess 19 comprising flat surfaces complementary to those of said polygonal shaft end 16. Shaft 13 has a transverse bore 21 for the reception of a bolt 20 that extends therethrough. A corresponding bore 22 extends entirely through leg 18, located to the right in FIG. 2. The two opposed flats of said shaft end 16 and said recess 19, through which said bores 21 and 22 extend coaxially, are perpendicular to the direction in which said bores extend. Bolt 20 extends through bores 21 and 22, and has a threaded end with which a nut 23 is engaged to secure shaft 13 to leg 18. This is suitably effected by having nut 23, when in-screwed, engage with a recessed portion 24 of said leg 18.

In order to make shaft 13 adjustable to a position turned round 90° from the position already shown, there is also provided a bore 25 extending through leg 17 located to the left in FIG. 2. Thus, bores 22 and 25 are located symmetrically in relation to the shaft-receiving recess 19 while including therebetween an angle of 90°. This arrangement makes it possible to make use of the peripheral bearing surface of shaft 13 twice as much as compared with that bearing surface used when having said shaft secured in one single position.

Referring to FIG. 3, there is shown an alternative embodiment of the roller cutter according to the invention, in which figure parts corresponding with those in the first embodiment already shown in FIG. 2 have same reference numerals. As appears therefrom, shaft end 16 is provided with two coaxial counterbores 26 and 27 each of which is arranged to be coaxial with bores 22 and 25 of said legs respectively when securing the shaft to the saddle in each said alternative position. The diameter of each said bore 26 and 27 is slightly larger than that of bolt-receiving bores 22 and 25. A portion 28 of the length of each said bore 22 and 25 is correspondingly widened to permit a cylindrical locking pin 29 to be partly received in both said coaxial bores 27 and 25 respectively, thus safely securing said pin 29 axially. This arrangement is formed to prevent the shaft from any rotational movement when the cutter being exerted to very large rotational forces.

While having described the invention in connection with specific embodiments thereof, it is to be clearly understood that this is done only by way of example. The shaft end may have other suitable polygonal shape — rectangular for instance — provided there is provided means for adjustment of said shaft in two positions turning around an angle of 0°–90°.

We claim:

1. A drill bit cutter assembly including:

a cutting unit rotatably mounted on a bearing shaft;

two opposed saddle structures each said saddle structure having two spaced-apart legs providing therebetween a recess for receiving an end of said shaft;

said recess and said shaft end being of complemental polygonal shape, said shaft end being secured to its recess by a bolt that extends through a transverse bore of the shaft and a saddle bore aligned therewith, the improved construction according to which both legs of said saddle are provided with bores each of which extends entirely through one leg, said bores being angled relative to one another, and said shaft-receiving recess between said legs being of a polygonal shape complemental to that of the shaft end such that said shaft is adjustable in two positions having its transverse bore aligned with said bores of said legs of the saddle in both said positions.

2. An assembly according to claim 1, wherein the bores in the respective saddle legs have between them an included angle which equals or is less than 90°.

3. A cutter according to claim 2, wherein the end of the bearing shaft is square-shaped, said bores extending through the legs of the saddle including an angle of 90° therebetween.

4. A cutter according to claim 1, according to which the shaft end is provided with a cylindrical counterbore on two opposed flats mating with a cylindrical locking pin partly received in said counterbore and partly in either of said bolt-receiving bores extending through the legs.

5. A cutter according to claim 5, wherein the cylindrical locking pin is partly received in said counterbore of the shaft and partly in a widened portion of said bolt-receiving bore extending through the legs.

* * * * *